US008782834B2

(12) United States Patent
Berg

(10) Patent No.: US 8,782,834 B2
(45) Date of Patent: Jul. 22, 2014

(54) PILLOW WITH INFLATABLE BLADDER ASSEMBLY

(75) Inventor: Allan Berg, Atlantic Beach, NY (US)

(73) Assignee: Bicor Processing Corp., Brooklyn, NY (US)

( * ) Notice: Subject to any disclaimer, the term of this patent is extended or adjusted under 35 U.S.C. 154(b) by 256 days.

(21) Appl. No.: 13/445,589

(22) Filed: Apr. 12, 2012

(65) Prior Publication Data

US 2013/0269111 A1 Oct. 17, 2013

(51) Int. Cl.
*A47G 9/10* (2006.01)

(52) U.S. Cl.
USPC ..... 5/644; 5/639; 5/645

(58) Field of Classification Search
CPC ..... A47G 9/1027; A47G 9/1081
USPC ..... 5/636, 639, 640, 644, 645, 655.3, 657, 5/708, 709
See application file for complete search history.

(56) References Cited

U.S. PATENT DOCUMENTS

| | | | | |
|---|---|---|---|---|
| 4,277,859 | A * | 7/1981 | Seaman | 5/639 |
| 4,528,705 | A * | 7/1985 | Greenawalt | 5/644 |
| 4,563,785 | A * | 1/1986 | Samelson | 428/102 |
| 4,984,315 | A * | 1/1991 | Ortman et al. | 5/631 |
| 5,557,815 | A * | 9/1996 | Mintz et al. | 5/636 |
| 6,047,425 | A * | 4/2000 | Khazaal | 5/644 |
| 6,327,725 | B1 * | 12/2001 | Veilleux et al. | 5/644 |
| 6,708,355 | B1 * | 3/2004 | Wang et al. | 5/644 |
| 7,513,002 | B2 * | 4/2009 | Best | 5/655.3 |
| 7,788,750 | B2 * | 9/2010 | Norstrem | 5/644 |
| 2012/0272453 | A1 * | 11/2012 | Jaskot | 5/644 |

* cited by examiner

*Primary Examiner* — Nicholas Polito
(74) *Attorney, Agent, or Firm* — Hoffman & Baron, LLP

(57) ABSTRACT

Provided is a pillow to support the head and neck of a user. The pillow includes an inflatable bladder assembly, sheet, fill material and pillow casing. The inflatable bladder assembly includes an inflatable bladder. The sheet has a pocket securing the bladder. The fill material has a fold defining a first panel and a second panel of the fill material. The sheet is disposed in the fill material such that the sheet spans the first panel and the second panel and the bladder is disposed about the fold. The pillow casing secures the fill material, sheet and bladder. The pillow casing has a stitching that secures the sheet in relation to the fill material and secures the fill material in relation to the pillow casing. The stitching defines a depression at a predetermined position of one or more of a top surface and a bottom surface of the pillow casing.

16 Claims, 4 Drawing Sheets

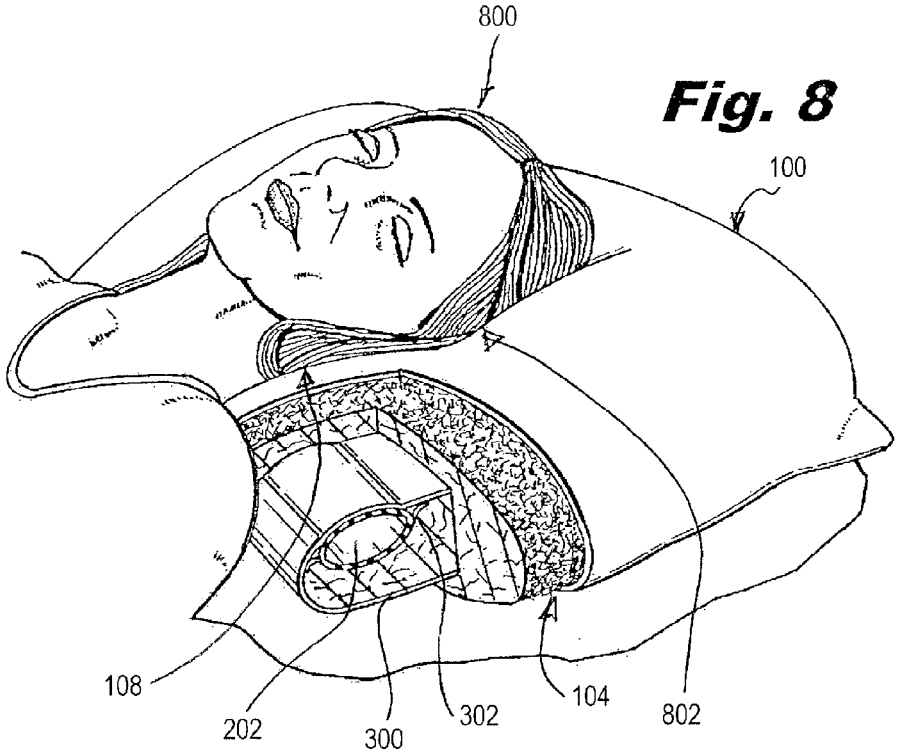
Fig. 8
Fig. 9
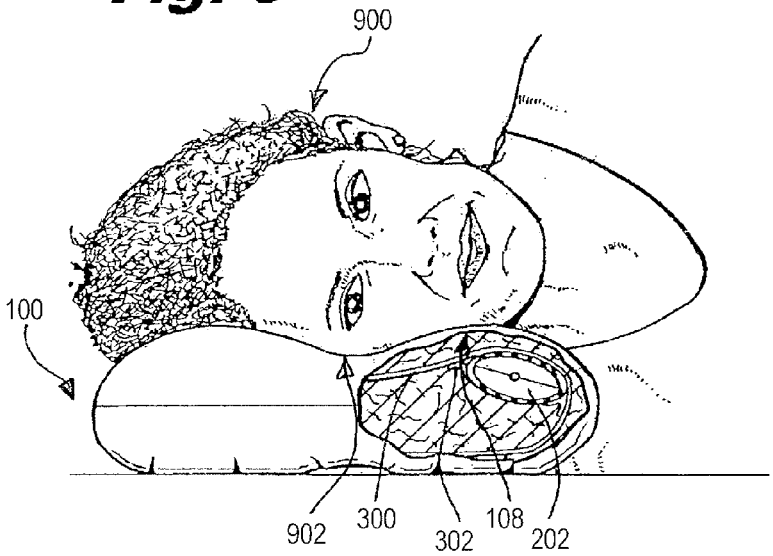

PILLOW WITH INFLATABLE BLADDER ASSEMBLY

BACKGROUND

1. Field

The present application relates to pillows. More specifically, the present application is directed to a pillow with an inflatable bladder assembly and a method of manufacturing a pillow with an inflatable bladder assembly.

2. Brief Discussion of Related Art

Invariably, rest and sleep are among the body's numerous mechanisms to heal itself from the postural, physical and nervous assaults throughout the previous day. Conventional pillows, which include a pillow casing and fill material, are known in the art and they have not undergone significant changes in the many years of pillow making In recent years, pillows that incorporate inflatable bladder assemblies have been designed to provide upper back, neck and head support in order to keep the upper spine and neck in neural positions. These pillows provide for comfort and support, and can make a difference in alleviating and/or avoiding back pain, neck pain and further in providing a restful and therapeutic night's sleep.

An inflatable bladder of the inflatable bladder assembly is disposed within the fill material in the pillow casing in a desired orientation, with an inflation bulb and valve assembly of the of the inflatable bladder assembly disposed to the outside of the pillow and connected to the bladder through the pillow casing via a flexible tubing. This allows the inflatable bladder disposed in the pillow to be inflated and deflated from the outside of the pillow.

Generally, the inflatable bladder is inserted within the fill material in the pillow casing but remains unsecured in relation to the pillow, including the pillow casing and the fill material. If a user is not careful, the constant pulling and tugging on the inflatable bladder via the flexible tubing—whether by the user operating the inflatable bladder or inadvertently by catching the inflation bulb and valve assembly on other objects—can cause the inflatable bladder in some cases to displace from the original desired orientation and in worst cases to come out of the pillow entirely.

There is a need in the art to provide a pillow that secures the inflatable bladder in a desired orientation in relation to the pillow casing and the fill material of the pillow to provide comfortable, restful and therapeutic sleeping positions for the user and to reduce the potential for shifting of the inflatable bladder from the desired orientation and/or damaging the pillow entirely, while reducing pillow production costs necessary to secure the inflatable bladder in the desired orientation in relation to the pillow.

SUMMARY

In accordance with an embodiment, a pillow to support head and neck of a user is disclosed. The pillow includes an inflatable bladder assembly, a sheet, a fill material and a pillow casing. The inflatable bladder assembly includes an inflatable bladder. The sheet has a pocket that secures the inflatable bladder. The fill material has a fold that defines a first panel and a second panel of the fill material. The sheet is disposed in the fill material such that the sheet spans the first panel and the second panel and the inflatable bladder is disposed about the fold. The pillow casing secures the fill material, the sheet and the inflatable bladder. The pillow casing has a stitching that secures the sheet in relation to the fill material and secures the fill material in relation to the pillow casing. The stitching defines a depression at a predetermined position of one or more of a top surface and a bottom surface of the pillow casing.

In accordance with another embodiment, a method of manufacturing a pillow to support head and neck of a user is disclosed. According to the method, an inflatable bladder of an inflatable bladder assembly is secured in a pocket that is secured to a sheet. The sheet is disposed atop a fill material having a first panel and a second panel such that the sheet spans the first panel and the second panel and the inflatable bladder is disposed about the fold between the first panel and the second panel. The fill material is then folded about the fold. The fill material, the sheet and the inflatable bladder are inserted in a pillow casing. The pillow casing is stitched to secure the sheet in relation to the fill material and to secure the fill material in relation to the pillow casing. The stitching defines a depression at a predetermined position of one or more of a top surface and a bottom surface of the pillow casing.

These and other purposes, goals and advantages of the present application will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings in which:

FIG. 8 illustrates an example use of the pillow constructed in accordance with FIGS. 1-7; and FIG. 9 illustrates another example use of the pillow constructed in accordance with FIGS. 1-7.

DETAILED DESCRIPTION

A pillow with an inflatable bladder assembly and a method of manufacturing a pillow with an inflatable bladder assembly are disclosed herein. In the following description, for the purposes of explanation, numerous specific details are set forth in order to provide a thorough understanding of example embodiments. It will be evident, however, to one skilled in the art, that an example embodiment may be practiced without all of the disclosed specific details.

Figure 1:
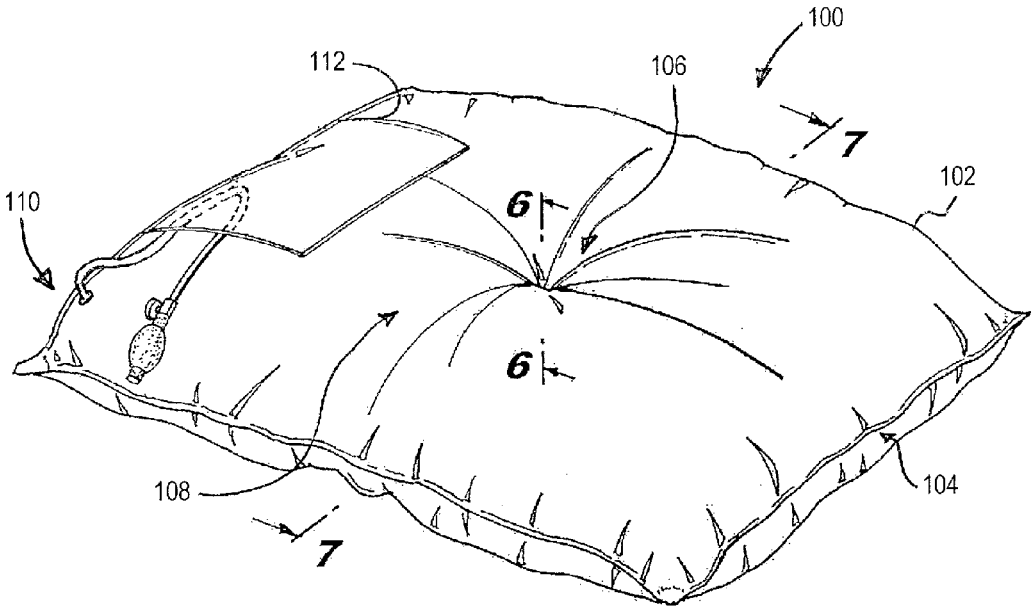
FIG. 1 illustrates a top perspective view of an example pillow with an inflatable bladder assembly secured in a desired orientation.

FIG. 1 illustrates a top perspective view of an example pillow 100 with an inflatable bladder assembly 110 secured in relation to the pillow 100. The pillow 100 includes a pillow casing 102, fill material 104, recess or depression 106, and an inflatable bladder assembly 110. In some embodiments, the pillow 100 can also include a pocket 112 as will be described in greater detail below.

The pillow 100 has dimensions including a length and a width, such as 15 inches by 22 inches or 20 inches by 26 inches. However, the pillow 100 can be of any conventional dimensions, or otherwise any desirable dimensions. The pillow 100 is configured to secure the inflatable bladder assembly 110 (e.g., inflatable bladder of the assembly 110) in a desired orientation in relation to the pillow casing 102 and the fill material 104 of the pillow 100, which can provide comfortable, restful and therapeutic sleeping positions for the user and can further reduce the potential for shifting of the inflatable bladder assembly 110 (e.g., inflatable bladder of the assembly 110) from the desired orientation and/or damaging the pillow entirely.

As will be described herein in greater detail herein, the construction of the pillow 100 is configured to reduce production costs necessary to secure the inflatable bladder assembly 110 (e.g., inflatable bladder of the assembly 110) in the desired orientation in relation to the pillow casing 102 and the fill material 104 of the pillow 100.

The pillow casing 102 is configured (e.g., sized and dimensioned) to receive the fill material 104 and to secure the inflatable bladder assembly 110 (e.g., inflatable bladder of the assembly 110) in relation to the pillow casing 102 and the fill material 104. The pillow casing 102 can be made of cotton, a combination of cotton and another material (e.g., polyester-cotton combination), or any other conventional material or combination of materials (e.g., silk, satin and/or other materials).

The fill material 104 can be a slick fiberfill, (e.g., silicon-coated material), a dry fiberfill, (e.g., a garneted material). Other fill materials can be used. The fill material 104 can be formed in a sheet having a length and width, which can be folded one or more times into a configuration (e.g., having width, length, height) that can be inserted into the pillow casing 102. The amount of fill material 104 in the sheet can be varied to provide various degrees of softness/firmness to the pillow 100. Although other fill materials are not described herein for brevity and clarity, they are nonetheless considered to be within the scope of the present application.

Further with reference to FIG. 1, the recess or depression 106 is located at a predetermined position about the pillow casing 102 and to the interior of or below the outer portion 108 of the pillow 100. In some embodiments, the depression 106 is located about centrally along the length and width of the pillow 100. As will be described in greater detail below with reference to FIG. 6, the recess or depression 106 can be formed by compressing the pillow 100 at the predetermined position along its length and width, and securing the top surface to the bottom surface of the pillow 100 via a stitching or in another manner at a predetermined distance from one another.

In other embodiments, the depression 106 can also be offset from about the center of the pillow 100 depending on the particular requirements. For example, the recess or depression 106 can be disposed at about one third of the width of the pillow 100. Similarly, the depression 106 can be disposed at any other location along width and the length of the pillow 100.

The innermost shape of the recess or depression 106 can be generally circular, of another shape, or a combination of shapes. If circular, the diameter of the depression 106 can be from about 1 inch to about 3% of an inch. Other diameters are of course possible.

The innermost shape of the depression 106 can also be a point or can have a length and a width, such as a square or a rectangle, or can be another geometrical shape or multiple shapes of different dimensions. Similarly, the width of the rectangle (or side of a square) extending along the width of the pillow 100 can be from 1 inch to about 3% of an inch. Other widths are of course possible.

An advantage associated with the point, circular and in some cases other shapes, is that the innermost shape forms the depression 106 that has an approximately conically sloped shape, having approximately outwardly sloped walls, which can approximate the size of the head of a user and can effectively cradle the user's head during operation or use of the pillow 100. That is, the person's head can be cradled in the depression 106 and supported by the outwardly sloping walls, while the higher portion 108 of the sleeping pillow 100 can support the neck and a part of the upper back of the user.

The inflatable bladder assembly 110 (e.g., inflatable bladder of the assembly 110) can disposed within the fill material 104 and secured to the pillow casing 102 such that the inflatable bladder assembly 110 can inflate/deflate to provide firmer/softer portion 108 to support the neck and a part of the upper back of the user, facilitating the user's comfortable, restful and therapeutic sleeping position.

The pocket 112 is optional and can be secured to the pillow casing 102 to retain at least a portion of the inflatable bladder assembly 110 (e.g., flexible tubing and/or inflation bulb and valve assembly of the inflatable bladder assembly 110). Once the inflatable bladder assembly 110 is inflated/deflated to a firmness/softness as desired, a portion of the inflatable bladder assembly 110 can be retained or stowed in the pocket 112 to avoid the possibility of interference with operation or use of the pillow 100 (e.g., user sleeping on the pillow) and/or to provide neatness to the pillow 100.

Figure 2:
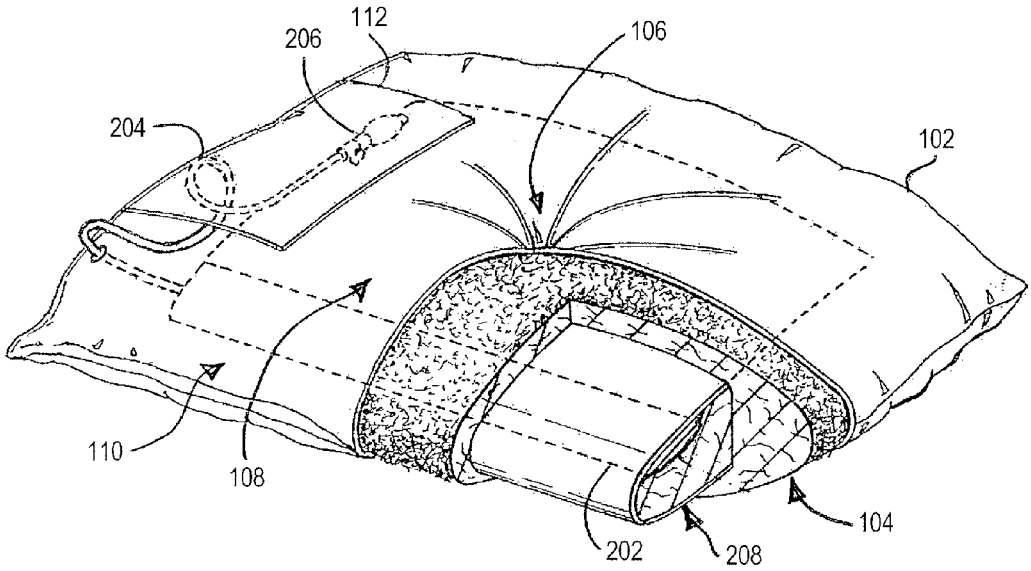
FIG. 2 illustrates the pillow of FIG. 1 cutaway to reveal the inflatable bladder assembly disposed in relation to the fill material and the pillow casing in the desired orientation via a sheet pocket and depression.

FIG. 2 illustrates the pillow 100 of FIG. 1 cutaway to reveal the inflatable bladder assembly 110 (e.g., inflatable bladder 202 of the inflatable bladder assembly 110) disposed within and secured to the fill material 104 and the pillow casing 102 in a selected or desired orientation (e.g., lengthwise orientation) via a sheet pocket 208 and depression 106.

The sheet pocket 208 and securing the bladder 202 of the inflatable bladder assembly 110 in relation to the sheet pocket 208 are described in greater detail with reference to FIG. 3, while securing the sheet pocket 208 via the depression 106 in relation to the pillow casing 102 and fill material 104 of the pillow 100 is described in greater detail with reference to FIG. 6.

In some embodiments as shown in FIG. 2, the sheet pocket 208 and the bladder 202 can be oriented approximately horizontally (e.g., extending approximately along the width of the pillow casing 102). In other embodiments, the sheet pocket 208 and bladder 202 can be oriented approximately vertically (e.g., extending approximately along the height of the pillow casing 102).

The inflatable bladder assembly 110 is configured to be inflated or deflated to provide a firmer or softer portion 108, respectively, such that the neck and a part of the upper back of the user can be supported with the firmness/softness as desired, facilitating the user's comfortable, restful and therapeutic sleeping position.

The inflatable bladder assembly 110 includes an inflatable bladder 202, flexible tubing 204 and inflation bulb and valve assembly 206. The inflatable bladder 202 of the inflatable bladder assembly 110 is configured to inflate to a desired firmness by actuating (e.g., hand pumping) the inflation bulb of the assembly 206. The firmness can be maintained by closing the valve of the assembly 206. Moreover, the firmness can be released to provide more softness by opening the valve of the assembly 206 and pressing on the bladder 202, thereafter closing the valve of the assembly 206 once a desired softness has been reached.

In some embodiments, the inflation bulb and valve assembly 206 can be replaced or substituted with an electric/electronic pump and valve assembly (not shown) that can be activated to provide inflation/deflation by a switch.

As illustrated in FIG. 2, a portion of inflatable bladder assembly 110 can be stowed in the pocket 112 to provide for ease of use or operation of the pillow 100. For example, a portion of the flexible tubing 204 and the inflation bulb and valve assembly 206 can be disposed in the pocket 112. Similarly, the portion of inflatable bladder assembly 110 can be stowed in the pocket 112 at other times when the pillow is not used.

Figure 3:
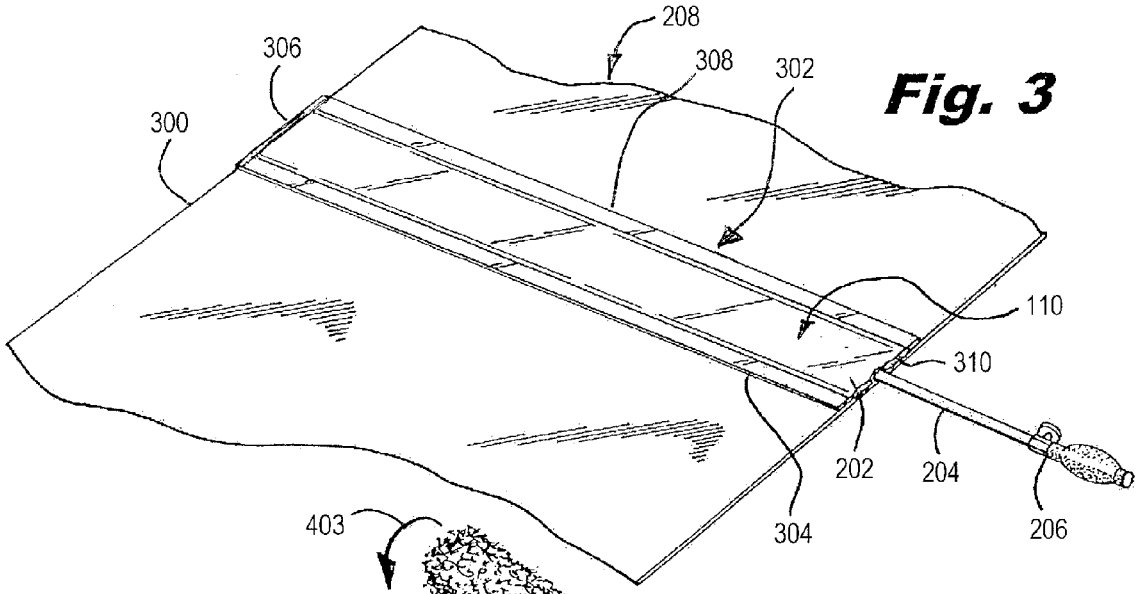
FIG. 3 illustrates the construction of the example sheet pocket of FIG. 2.

FIG. 3 illustrates the construction of the example sheet pocket 208 of FIG. 2. The sheet pocket 208 is configured to receive and secure the inflatable bladder assembly 110 (e.g., inflatable bladder 202 of the inflatable bladder assembly 110).

The sheet pocket 208 can be made of cotton, a combination of cotton and another material (e.g., polyester-cotton combination), other any other conventional material or combination of materials (e.g., silk, satin and/or other materials). The sheet pocket 208 includes a sheet 300 and a pocket 302.

The sheet 300 has a length and a width, which can be selected based on the dimensions of the pillow 100 (pillow casing 102 and fill material 104) to facilitate the sheet pocket 208 in being secured to the pillow casing 102 and to the fill material 102 via the depression 106 as will be described in greater detail below with reference to FIG. 6.

For example, in embodiments directed to a centrally disposed depression 106, the width of the sheet pocket 208 can be from about the width of the pillow casing 102 to about twice the width pillow casing 102. The width of the sheet pocket 208 can also be smaller depending on placement of the depression 106 in the pillow 100, such as when the depression 106 is offset. The length of the sheet pocket 208 can be about the length of the bladder 202, both of which lengths can be about or smaller than the length of the pillow 100.

The pocket 302 is formed along the length of the sheet 300. The pocket 302 is secured to the sheet 300 along edges 304, 306, 308. The edges can be stitched. Other methods of securing the pocket 302 to the sheet 300 can be used. For example, the edges 304, 306, 308 can be glued to the sheet 300. The pocket 302 is configured to receive the inflatable bladder 202 through opening 310. The dimensions of pocket 302 can conform substantially to the dimensions of the bladder 202. Once the bladder 202 is received into the pocket 302, the opening 310 is sealed. The opening can be stitched or glued. Other methods of sealing the opening 310 can be used.

Figure 4:
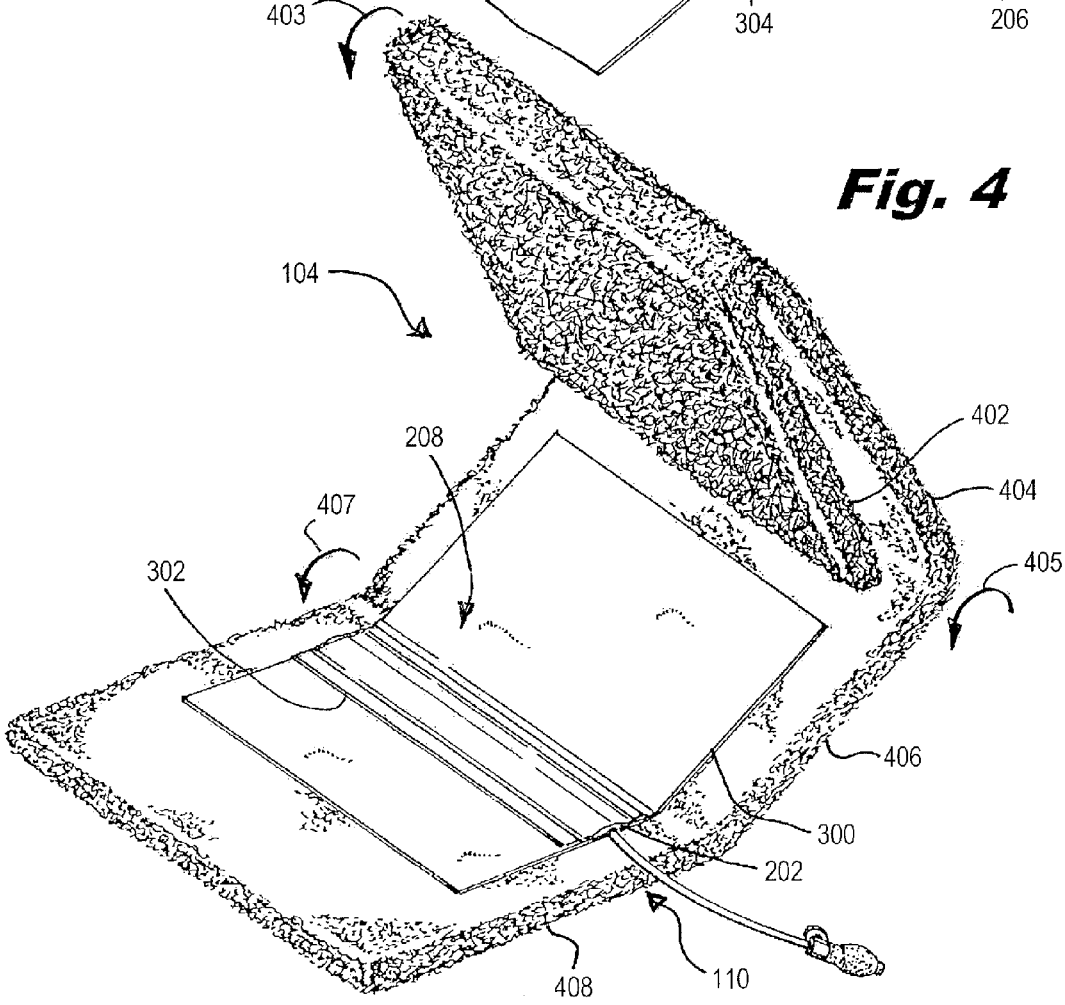
FIG. 4 illustrates integration of the sheet pocket into the fill material.

FIG. 4 illustrates integration of the sheet pocket 208 into the fill material 104. The fill material 104 is configured to secure the sheet pocket 208 to its interior.

As previously described, the fill material 104 can be a fiberfill formed in a sheet, which can be folded one or more times into the dimensions (e.g., width, length, height) that can be inserted into the pillow casing 102. For example, the fill material 104 can be thought of as having four (4) panels 402, 404, 406, 408, which can be folded at respective folds 403, 405, 407 according to the dimensions of the pillow casing 102 and inserted into the pillow casing 102, as will be described in greater detail below with reference to FIG. 5.

It is noted and should be understood that the fill material 104 is soft and that it is described as having panels for ease of understanding its construction and integration with the sheet pocket 208 and the inflatable bladder 202 of the assembly 110. Based on the dimensions of the pillow 100, the fill material 104 can be longer or shorter, such that it can be folded into more or fever panels to provide the desired height for the pillow 100.

The sheet pocket 208 can be disposed atop the fill material 104 spanning several panels (e.g., panels 406, 408), such that the pocket 302 is disposed approximately at a fold (e.g., fold 407) between the several panels (e.g., panels 406, 408). In some embodiments as shown in FIG. 4, the pocket 302 and the bladder 202 can be offset from the fold 407. In such construction, the pocket 302 will be oriented approximately horizontally (e.g., extending approximately along the width of the pillow casing 102) as illustrated FIG. 2. In other embodiments, the pocket 302 and bladder 202 can be oriented at the fold 407. In such construction, the pocket 302 will be oriented approximately vertically (e.g., extending approximately along the height of the pillow casing 102).

As illustrated in FIG. 4, the panels 402, 404, 406, 408 are folded at respective folds 403, 405, 407, such that panels 402, 404 fold to the interior of panels 406, 408. For example, a first portion of the sheet pocket 208 is between panels 402, 406 and a second portion of the sheet pocket 208 is between panels 404, 408. The panels 406, 408 form the exterior of the folded fill material 104, securing the sheet pocket 208 and bladder 202 in the fill material 104.

In the folded configuration, the panels 402, 406 provide a substantial friction surface to the first portion of the sheet pocket 208 and the panels 404, 408 provide a substantial friction surface to the second portion of the sheet pocket 208, thereby securing the sheet pocket 208 and the inflatable bladder 202 within the fill material 104, preventing or reducing the potential for shifting of the inflatable bladder 202 from the desired orientation in the pillow 100 and/or damaging the pillow 100.

Figure 5:
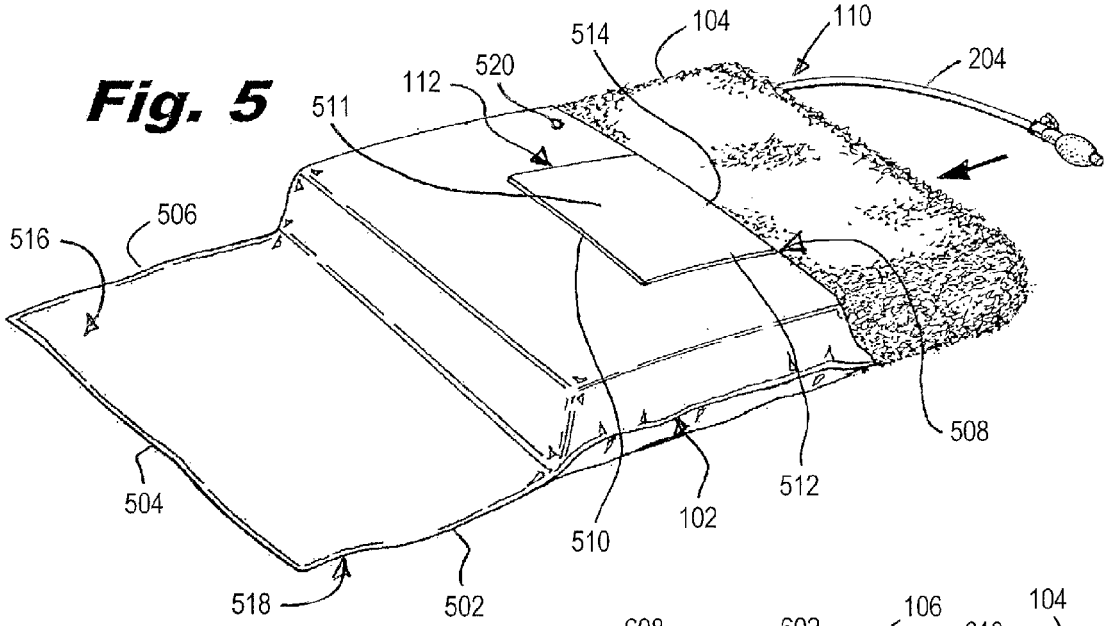
FIG. 5 illustrates an example top perspective view of the pillow casing that receives the fill material integrated with the inflatable bladder assembly via the sheet pocket.
Figure 6:
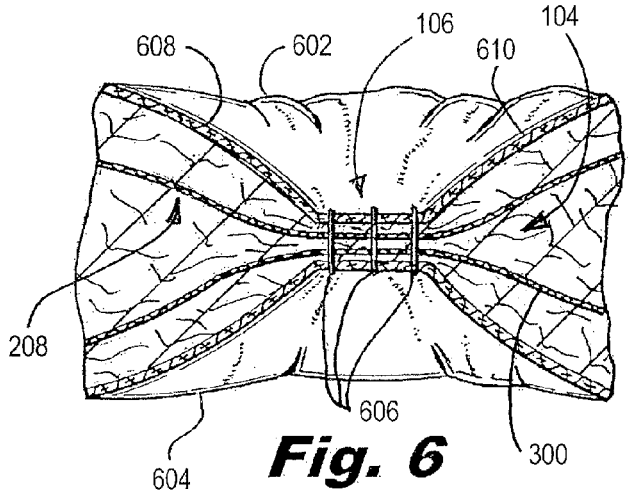
FIG. 6 illustrates example construction of the depression in the pillow casing filled with fill material that secures the inflatable bladder assembly via the sheet pocket to the pillow casing and the fill material.
Figure 7:
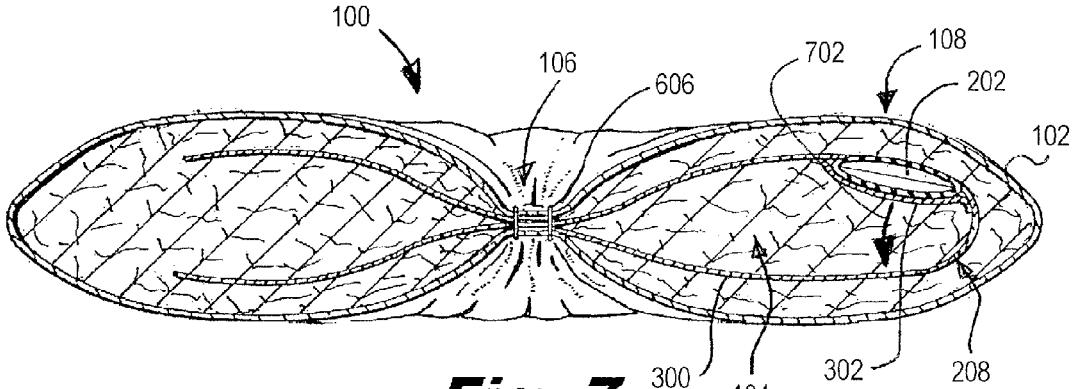
FIG. 7 illustrates an example cross-sectional view of the pillow constructed in accordance with FIGS. 1-6.

FIGS. 5-7 illustrate the construction of the pillow 100 with the inflatable bladder assembly 110 (e.g., bladder 202 of the inflatable bladder assembly 110) secured within the fill material 104 by the sheet pocket 208 and secured within the pillow casing 102 by the depression 106.

FIG. 5 illustrates an example top perspective view of the pillow casing 102 that receives or is filled with the fill material 104, which is integrated with the inflatable bladder assembly 110 (e.g., inflatable bladder 202 of the inflatable bladder assembly 110) via the sheet pocket 208.

The pillow casing 102 of the sleeping pillow 100 can be made of two sheets of fabric (e.g., cotton, combination of cotton and another material, or one or more other materials as described herein), including a top sheet and bottom sheet. The sheets are sewn together along three of the four edges thereof and the sheets are then inverted to provide the pillow casing 102, hiding the sewn seams to the interior of the pillow casing 102. The finished and inverted pillow casing 102 is shown in FIG. 5 in which the top and bottom sheets 516, 518 have been sewn along three edges 502, 504, 506, leaving an opening 508 along the fourth edge of the pillow casing 102.

A third sheet 511 can be sewn to the top sheet 516 to form the pocket 112. The third sheet 511 can be sewn at edges 510, 512, 514 before or after the top and bottom sheets 516, 518 are sewn together. In some embodiments, the third sheet 511 can be sewn to the top sheet 516 at two edges 510, 512, where the third edge 514 is sewn when the opening 508 between sheets 516, 518 is sewn.

The fill material 104—as folded and integrated with the inflatable bladder assembly 110 (e.g., bladder 202) via the sheet pocket 208—is inserted into the pillow casing 102 through the opening 508 and the flexible tubing 204 is inserted through an opening in the pillow casing 102. The pillow casing 102 conforms to the fill material 104 as the fill material 104 is inserted into the pillow casing 102. Once the fill material 104 is fully inserted into the pillow casing 102, the sheets 516, 518 are sewn at the edge about the opening 508 to seal the pillow casing 102.

In some embodiments, the flexible tubing 204 extends through an opening 520 in the top sheet 516. In other embodiments, the flexible tubing 204 can extend through a portion of the opening 508 between the sheets 516, 518 that is not sewn. In this case, the opening 520 in the top sheet 516 can be omitted. It is noted that the opening 520 can be provided through the top sheet 516 inside the pocket 112, such that the flexible tubing 204 is not visible when the inflatable bladder assembly 110 is not in use and is stowed in the pocket 112.

FIG. 6 illustrates example construction of the depression 106 in the pillow casing 102 filled with fill material 104 that secures the inflatable bladder assembly 110 (e.g. inflatable bladder 202) via the sheet pocket 208 to the pillow casing 102 and the fill material 104.

More specifically, the recess or depression 106 can be formed using a compression tack machine (not shown), which compresses the pillow casing 102 of the pillow 100 at the predetermined position along its length and width, securing the top surface 602 to the bottom surface 604 via stitching 606 at a predetermined distance from one another as shown in FIG. 6. The compression tack machine can be used to form the various shapes as described in relation to the depression 106 (e.g., point, square, rectangle and one or more other shapes or combinations of shapes).

It is noted, there are other alternative machines and mechanisms that can form the recess or depression 106 as described herein.

The depression 106 forms approximately outwardly sloped walls 608, 610 about the depression 106 extending to the top surface 602 of the pillow 100, which can approximate the size of the head of the user. That is, the person's head can be cradled in the depression 106 and supported laterally by the outwardly sloping walls 608, 610, while the higher portion 108 of the sleeping pillow 100 as illustrated in FIG. 1 supports the neck and a part of the upper back of the user. While the sloping walls 608, 610 are described in relation to the top surface 602, it should be noted that the same or similar sloping walls are formed in relation to the depression in the bottom surface 604 of the pillow 100.

FIG. 7 illustrates an example cross-sectional view of the pillow 100 constructed in accordance with FIGS. 1-6. The inflatable bladder 202 of the inflatable bladder assembly 110 has been secured in the fill material 104 via the pocket 302 (of sheet pocket 208) and attached to the pillow casing 102 and fill material 104 in an example orientation via the stitching 606 through the sheet 300, forming the depression 106.

As described in greater detail with reference to FIG. 4, the pocket 302 and the inflatable bladder 202 can be oriented approximately horizontally (e.g., extending approximately along the width of the pillow casing 102), or the pocket 302 and inflatable bladder 202 can be oriented approximately vertically (e.g., extending approximately along the height of the pillow casing 102).

The inflatable bladder 202 is illustrated as semi-inflated to provide a relatively little amount of firmness to the outer portion 108 of the pillow 100. The inflatable bladder 202 can be deflated to provide a softer outer portion 108 or inflated to provide a firmer outer portion 108.

More specifically, with inflation illustrated generally at arrow 702, the inflatable bladder 202 can expand in the pocket 302 to force the fill material around the bladder 202 and the pocket 302 against the pillow casing 102, providing greater firmness at the outer portion 108 of the pillow 100. With various amounts of inflation or deflation of the inflatable bladder 202, the fill material 104 can expand or contract about the inflatable bladder 202 to provide various amounts of force to pillow casing 102, causing more or less firmness/softness at outer portion 108 of the pillow 100.

FIG. 8 illustrates an example use of the pillow 100 that is constructed in accordance with FIGS. 1-7. As shown in operation of FIG. 8, a user 800 can use the pillow 100 to sleep in a generally supine position, lying on his/her back or having the face upward, as particularly illustrated in FIG. 8. More specifically, the back of the user's head 802 can be cradled in the depression 106 (illustrated in FIG. 1) and the user's head supported by the outwardly sloping walls 608, 610 (illustrated in FIG. 6), while the higher portion 108 of the sleeping pillow 100 will support the neck (and a portion of the upper back) of the user 800. The provision of firmer/softer outer portion 108 in the pillow 100 can be accomplished by inflating or deflating the inflatable bladder 202.

FIG. 9 illustrates another example use of the pillow 100 that is constructed in accordance with FIGS. 1-7. As shown in operation of FIG. 9, a user 900 can use the pillow 100 by sleeping on the user's side, with the side of the user's head 902 fitting the depression 106, as particularly depicted in FIG. 9. More specifically, the side of the user head 902 can be cradled in the depression 106 and the user's head supported by the outwardly sloping walls 608, 610 (illustrated in FIG. 6), while the higher portion 108 of the sleeping pillow 100 will support the neck of the user 900. The provision of the firmer/softer outer portion 108 in the pillow 100 can be accomplished by inflating or deflating the inflatable bladder 202 as described herein.

Concerning the example uses of the pillow 100 illustrated in FIGS. 8 and 9, alternative sleeping positions are contemplated. In these alternate positions, the depression 106 will likewise cradle and support a part of the user's head and neck, and the higher portion 108 will further support the user's neck (and potentially the upper back).

Thus, a pillow with an inflatable bladder assembly and a method of manufacturing a pillow with an inflatable bladder assembly have been described. Although specific example embodiments have been described, it will be evident that various modifications and changes may be made to these embodiments without departing from the broader spirit and scope of the invention.

Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments shown are described in sufficient detail to enable those skilled in the art to practice the teachings disclosed herein. Other embodiments may be utilized and derived therefrom, such that structural and logical substitutions and changes may be made without departing from the scope of this application.

The foregoing detailed description, therefore, is not to be taken in a limiting sense, and the scope of various embodiments is defined only by the appended claims, along with the full range of equivalents to which such claims are entitled.

Although specific embodiments have been shown and described herein, it should be appreciated that any arrangement calculated to achieve the same purpose may be substituted for the specific embodiments shown. This application is intended to cover any and all adaptations or variations of various embodiments. Combinations of the above embodiments and other embodiments not specifically described herein, will be apparent to those of skill in the art upon reviewing the above description.

The Abstract is provided to comply with 37 C.F.R. §1.72(b) and will allow the reader to quickly ascertain the nature of the technical disclosure of this application. It is submitted with the understanding that it will not be used to interpret or limit the scope or meaning of the claims.

In the foregoing detailed description, various features may be grouped together in a single embodiment for the purpose of streamlining the disclosure of this application. This method of disclosure is not to be interpreted as reflecting that the claimed embodiments have more features than are expressly recited in each claim. Rather, as the following claims reflect, inventive subject matter lies in less than all features of a single disclosed embodiment.

Moreover, it is contemplated that the features or components of various embodiments described herein can be combined into different combinations that are not explicitly enumerated in the foregoing detailed description and that such combinations can similarly stand on their own as separate example embodiments that can be claimed.

The invention claimed is:

1. A pillow to support head and neck of a user, the pillow comprising:

an inflatable bladder assembly comprising an inflatable bladder;

a sheet having a pocket that secures the inflatable bladder;

a fill material having a fold that defines a first panel and a second panel of the fill material, the sheet disposed in the fill material such that the sheet spans the first panel and the second panel and the inflatable bladder is disposed about the fold; and a pillow casing to secure the fill material, the sheet and the inflatable bladder, the pillow casing having a stitching that secures the sheet in relation to the fill material and secures the fill material in relation to the pillow casing, wherein the stitching defines a depression at a predetermined position of one or more of a top surface and a bottom surface of the pillow casing.

2. The pillow according to claim 1, wherein the predetermined position of the depression is about the center of the pillow casing.

3. The pillow according to claim 1, wherein the depression has a conically sloped shape.

4. The pillow according to claim 1, wherein the pillow has dimensions including a length and a width.

5. The pillow according to claim 4, wherein the dimensions are selected from the group consisting of: 15 inches by 22 inches; and 20 inches by 26 inches.

6. The pillow according to claim 1, wherein the stitching secures the top surface and the bottom surface in approximately a circular shape at about the predetermined position of the pillow casing, the circular shape having a diameter from about 1 inch to about 3% of an inch.

7. The pillow according to claim 1, wherein the stitching secures the top surface and the bottom surface in at least one shape selected from a group consisting of: a point; a circle; a square; and a rectangle.

8. The pillow according to claim 1, wherein the fill material is one selected from the group consisting of: a slick fill material; and a dry fill material.

9. The pillow according to claim 1, wherein the inflatable bladder assembly further comprises:

an inflation bulb and valve assembly configured to allow the inflatable bladder to inflate and deflate; and a flexible tubing connecting the inflatable bladder to the inflation bulb and valve assembly.

10. The pillow according to claim 9, wherein the pillow casing comprises an opening configured to allow the flexible tubing to extend from the bladder to outside of the pillow casing.

11. The pillow according to claim 10, wherein the pillow casing comprises an external pocket that is disposed over the opening to receive the flexible tubing and the inflation bulb and valve assembly.

12. The pillow according to claim 9, wherein the pillow casing comprises an external pocket to receive a portion of the flexible tubing and the inflation bulb and valve assembly.

13. A method for making a pillow to support head and neck of a person, the method comprising:

securing an inflatable bladder of an inflatable bladder assembly in a pocket secured to a sheet;

disposing the sheet atop a fill material having a first panel and a second panel such that the sheet spans the first panel and the second panel and the inflatable bladder is disposed about a fold between the first panel and the second panel;

folding a fill material about the fold; and inserting the fill material, the sheet and the inflatable bladder in a pillow casing; and stitching the pillow casing to secure the sheet in relation to the fill material and to secure the fill material in relation to the pillow casing, the stitching defining a depression at a predetermined position of one or more of a top surface and a bottom surface of the pillow casing.

14. The method of claim 13, wherein the method further comprises closing the pillow casing to enclose the fill material, the sheet and the inflatable bladder in the pillow casing.

15. The method of claim 13, the method further comprising:

providing an opening through the top surface of the pillow casing; and extending a flexible tubing from the inflatable bladder through the opening to outside of the pillow casing and to an inflation bulb and valve assembly.

16. The method according to claim 15, wherein the method further comprises providing an external pocket atop the pillow casing to receive at least a portion of the flexible tubing and the inflation bulb and valve assembly.

* * * * *

UNITED STATES PATENT AND TRADEMARK OFFICE

CERTIFICATE OF CORRECTION

PATENT NO. : 8,782,834 B2
APPLICATION NO. : 13/445589
DATED : July 22, 2014
INVENTOR(S) : Allan Berg It is certified that error appears in the above-identified patent and that said Letters Patent is hereby corrected as shown below:

IN THE SPECIFICATION:

Column 3, line 66:

Now reads: "3% of an inch"

Should read: -- 3⅞ of an inch --

Column 4, line 6:

Now reads: "3% of an inch"

Should read: -- 3⅞ of an inch --

Column 5, line 23:

Now reads: "other any other"

Should read: -- or any other --

Column 6, line 3:

Now reads: "more or fever panels"

Should read: -- more or fewer panels --

Column 9, line 55:

Now reads: "to about 3% of an inch"

Should read: -- to about 3⅞ of an inch --

Signed and Sealed this
Seventh Day of April, 2015

Michelle K. Lee

Michelle K. Lee
*Director of the United States Patent and Trademark Office*